US006616768B2

(12) United States Patent
Madsen

(10) Patent No.: US 6,616,768 B2
(45) Date of Patent: Sep. 9, 2003

(54) METHOD IN PROCESSING GYPSUM BOARDS OR TILES

(75) Inventor: Benni Madsen, Kalundborg (DK)

(73) Assignee: BPB PLC, Slough (GB)

( * ) Notice: Subject to any disclaimer, the term of this patent is extended or adjusted under 35 U.S.C. 154(b) by 0 days.

(21) Appl. No.: 09/891,303

(22) Filed: Jun. 27, 2001

(65) Prior Publication Data

US 2002/0086114 A1 Jul. 4, 2002

Related U.S. Application Data

(63) Continuation of application No. PCT/EP00/10501, filed on Oct. 25, 2000.

(30) Foreign Application Priority Data

Oct. 27, 1999 (SE) ..... 9903866

(51) Int. Cl.[7] ..... B08B 7/04

(52) U.S. Cl. ..... 134/6; 134/9; 134/64 R; 134/122 R; 134/30; 134/34; 134/37; 15/302; 15/308; 15/309.2

(58) Field of Search ..... 15/302, 306.1, 15/308, 309.1, 302.2, 303; 134/122 R, 64 R, 26, 30, 32, 34, 37, 6, 9

(56) References Cited

U.S. PATENT DOCUMENTS

| | | | | | |
|---|---|---|---|---|---|
| 3,984,269 | A | * | 10/1976 | Schneller et al. | 156/71 |
| 5,024,780 | A | * | 6/1991 | Leys | 510/174 |
| 5,332,428 | A | * | 7/1994 | Yoshioka et al. | 106/2 |
| 5,346,640 | A | * | 9/1994 | Leys | 510/174 |
| 5,958,149 | A | * | 9/1999 | Callaghan et al. | 134/38 |

FOREIGN PATENT DOCUMENTS

| | | | | | |
|---|---|---|---|---|---|
| JP | 52074633 | A | * | 6/1977 | B05D/7/00 |
| JP | 03184804 | A | | 8/1991 | |
| JP | 05278019 | | | 10/1993 | |
| WO | WO 9810908 | | | 3/1998 | |
| WO | WO0130553 | A | * | 5/2001 | |

* cited by examiner

*Primary Examiner*—Alexander Markoff

(57) ABSTRACT

A method of processing perforated gypsum boards is disclosed. When the gypsum boards have been perforated the following steps are performed while the boards are being moved individually along a path. The moving boards are sprayed with pressurized water which is directed towards the opposite surfaces of the boards so as to enter apertures or slots formed by the perforation of the boards, and then water is removed from the moving boards by blowing pressurized air against the boards and sucking water therefrom, wherein dust on the boards is entrained into the water and removed from the boards together with the water.

9 Claims, 2 Drawing Sheets

METHOD IN PROCESSING GYPSUM BOARDS OR TILES

This application is a continuation of PCT/EP00/10501, filed Oct. 25, 2000 and published in English on May 3, 2001 as WO 01/30553.

BACKGROUND OF THE INVENTION

1. Field of the Invention

The invention relates to a method in processing gypsum boards or tiles to be mounted on a framework in wall constructions or as a lining in ceilings and on walls, including gypsum boards or tiles consisting of a gypsum core with a protective and binding layer of paper on each side thereof, and gypsum boards and tiles consisting of a mixture of gypsum and fibre material, or more generally any board or tile including gypsum as an essential constituent thereof. In the following the term "board" will be used as including gypsum boards as well as gypsum tiles More particularly the invention relates to the processing of gypsum board of any kind mentioned above perforated e.g. by circular or square apertures or by slots arranged on the gypsum board in different patterns, the perforation being formed e.g. by punching or sawing. Such perforated gypsum boards often are provided at one side thereof with a woven or felted textile material, which in combination with the apertures or slots improves the sound absorbing properties of the gypsum board. The gypsum board may be varnished in order to improve the appearance thereof.

2. Description of Related Art

Perforation of the gypsum board creates uncovered shear surfaces in the apertures or slots, from which gypsum particles are detached, such particles being emitted to the surroundings as dust when the gypsum boards are shipped or mounted or are being used. The emission of such dust is felt as a problem when handling perforated gypsum boards during storing, distribution and use thereof. Brushing of the gypsum boards in order to remove the gypsum dust therefrom has been found not to be sufficient in order to avoid the problem of dusting. Moreover, gypsum dust covering the surfaces of the gypsum board causes difficulties when the boards are to be painted since the dust prevents the paint from adhering to the board surfaces.

BRIEF SUMMARY OF THE INVENTION

The object of the present invention is to eliminate the problem by processing steps which easily can be incorporated in an automatic continuous production line without changes in the production method being necessary.

According to the invention said object is achieved by the method of claim 1. By this method the dust can effectively be removed from the gypsum boards without causing damages to the boards. Since small amounts of water can be used for an efficient cleaning of the boards and water is blown and/or sucked off the boards the consumption of energy for drying the boards when they have been sprayed with water can be held at an acceptable low level.

BRIEF DESCRIPTION OF THE DRAWINGS

An illustrative embodiment of the method of the invention will be described below reference being made to the accompanying drawings in which.

DETAILED DESCRIPTION OF THE INVENTION

Figure 1:
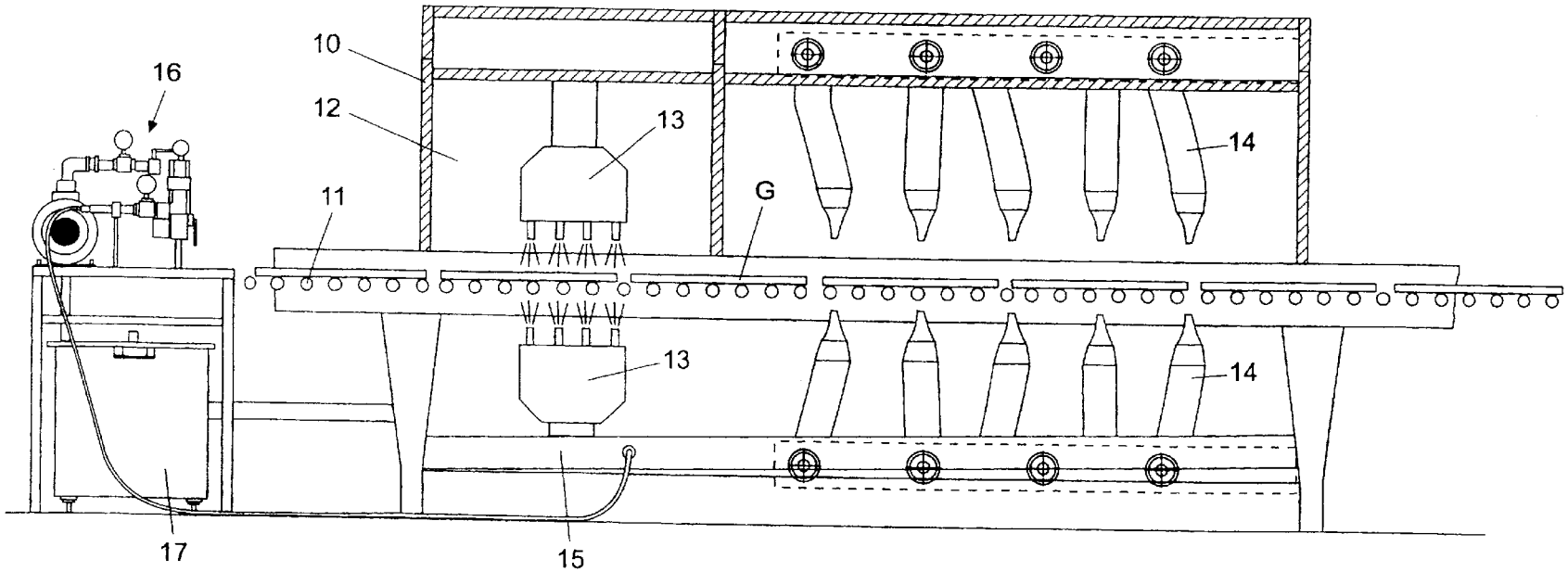
FIG. 1 is a longitudinal cross sectional view of an apparatus for working the method of the invention, which can be incorporated into a production line for processing gypsum boards.
Figure 2:
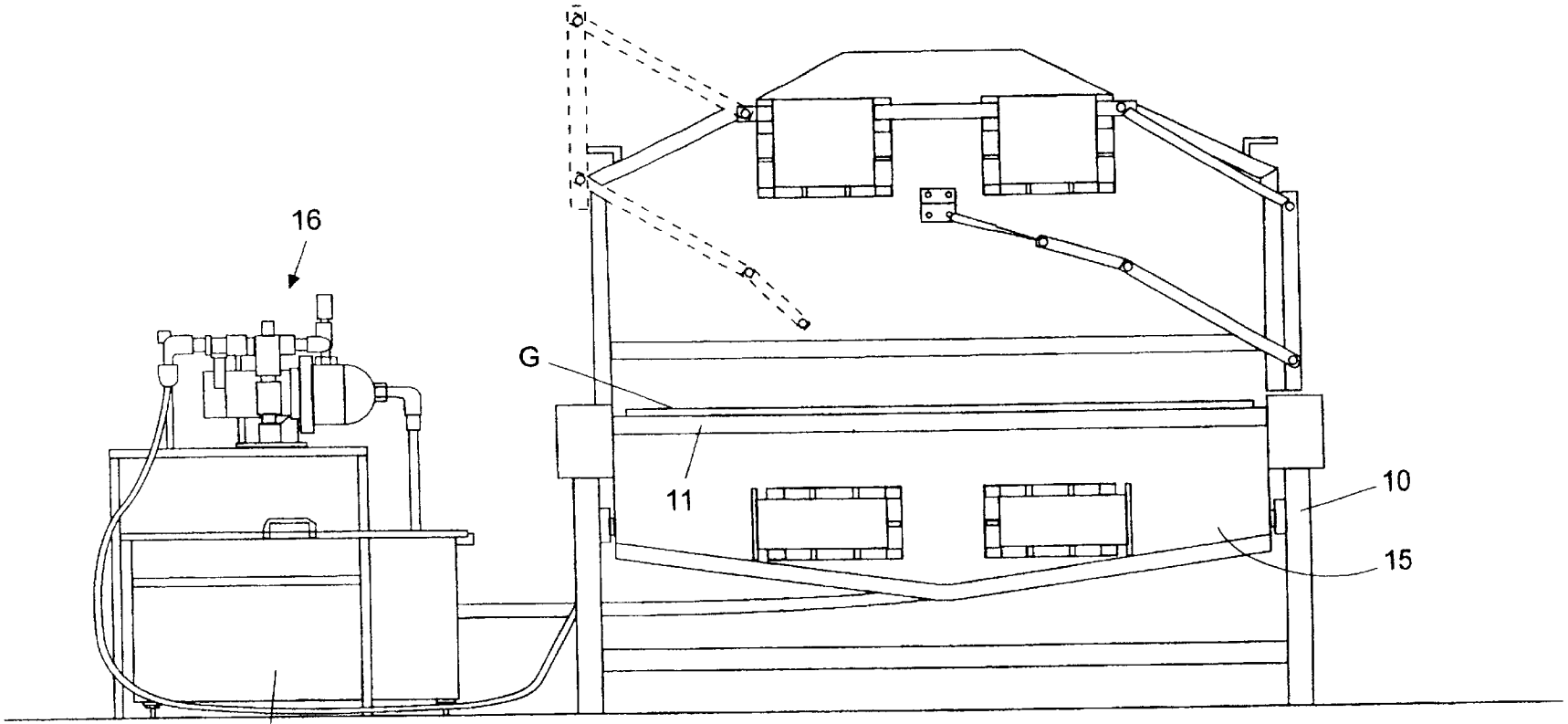
FIG. 2 is an end view of the apparatus in FIG. 1.

The apparatus disclosed in the drawings comprises a framework 10 with a roll conveyor 11 mounted therein said roll conveyor being of the type having rolls comprising thin disks mounted on a common shaft mutually spaced for supporting the gypsum boards laying on the disks. This conveyor shall connect to a conveyor path at each end thereof in order to receive gypsum boards G at one end—the left end in FIG. 1—and to deliver at the other end—the right end in FIG. 1—gypsum boards after processing according to the method of the invention in the apparatus disclosed. The gypsum boards arriving at the apparatus can be of any type mentioned above and shall be perforated e.g. by circular or square apertures or by slots. Preferably, the gypsum boards are brushed before they arrive at conveyer 11 so as to remove as far as possible such gypsum dust as adheres to the boards after punching or sawing. The purpose of processing the gypsum boards according to the method of the invention is to further clean the boards from remaining gypsum dust that has not been removed by brushing, such dust to a substantial part being located in the apertures or slots. In order to reduce the absorption of water into the boards the surfaces and/or the core thereof may have been impregnated with silicone or wax at the manufacture of the boards.

The apparatus comprises a chamber 12 in which spray nozzles 13 are mounted for spraying the surfaces of the gypsum boards G laying on the roll conveyor from above and from below.

Downstream of chamber 11 as seen in the moving direction of the gypsum boards G (from the left to the right) nozzles 14 are provided for directing air jets towards the gypsum boards on the roll conveyor from above and from below and sucking water therefrom. These nozzles can also be adjusted vertically in order to be located at a suitable level, and should be of the type having narrow outlet and inlet openings extending in parallel in the transverse direction of the conveyor over the width thereof; a device of this type is termed an "air-knife". The inlet and outlet openings converge towards each other and the angle thereof is adjustable. By means of these nozzles a sharp jet of pressurized air is directed towards the gypsum boards G from above and from below over the width thereof through the outlet opening, water and air at the same time being sucked away through the inlet opening of the nozzle. The speed of the pressurized air which is blown against the boards from the nozzles preferably is of the order of about 50 m/sec at the mouth of the nozzles. Alternatively, blowing can take place at one side of the boards and sucking at the other, and along the production line blowing and sucking can take place alternatingly at one side and the other, respectively. A tub 15 is provided in the framework for collecting the surplus of water supplied. A pump aggregate 16 including a water tank 17 draws water from tub 15 for recirculation to the water nozzles and also adds fresh water from tank 17 to the circulating water as may be necessary. Water in the air withdrawn by the nozzles is separated from the air and supplied to the pump aggregate for recirculation.

The apparatus described is enclosed so as to prevent water and humid air from escaping to the surroundings.

When the perforated and brushed gypsum boards (G) are moving through the apparatus described on the roll conveyor 11 from the left to the right as seen in FIG. 1 they are sprayed with a mist of water when passing the upper and lower spray nozzles 13 in chamber 12. A suitable binding agent such as a latex based binding agent may be added to the water to reduce dusting. Since the pressure of the water supplied is low there is no risk of the gypsum boards being damaged. The nozzles 13 should only be big enough to supply the amount necessary in order to rinse the total surface of the gypsum board at each side thereof and in order to have the water penetrate the apertures or slots in the gypsum board in a sufficient amount in order to rinse off the gypsum dust therein.

When the gypsum boards proceed further through the apparatus they arrive at the air knifes 14 which remove the water remaining on the surfaces of the gypsum boards and in the perforation thereof. The air passes through the apertures or slots in the boards. The water leaving the gypsum boards removes gypsum dust therefrom, also from the apertures or slots, such dust being entrained into the water removed from the boards. The water is recirculated and can pass through a filter in the recirculation system in order to separate solid particles therefrom before the water is reused in the apparatus.

From the apparatus for working the method of the invention the gypsum boards G at the right end of the conveyor continue through the processing line for further processing such as drying, sealing, painting, and application of textile material, and for packaging.

For an economic treatment of the gypsum boards the processing parameters should be optimized in order to obtain an efficient removal of dust from the boards and to keep the energy required in order to remove from the gypsum boards the water with gypsum dust entrained therein, as low as possible.

I claim:

1. A method in processing perforated gypsum boards, wherein the gypsum boards after having been perforated are processed by the steps of:

moving individual boards along a path;

spraying the moving boards with water which is directed towards the opposite surfaces of the boards so as to enter apertures or slots formed by the perforation of the boards; and removing water from the moving boards by air-knifes blowing pressurized air against the boards and sucking water therefrom.

2. The method according to claim 1, wherein the air-knifes are directed in an oblique angle against the boards.

3. The method according to claim 2, wherein the air-knifes extend over the entire width or length of the boards.

4. The method according to claim 1, wherein the water is sprayed onto the moving boards as a mist.

5. The method according to claim 1, wherein the water is mixed with a binding agent.

6. The method according to claim 1, wherein the surfaces of the board or a core thereof is impregnated.

7. The method according to claim 1, the water sprayed onto the boards is collected and is recirculated for repeated use as spray water.

8. The method according to claim 1, wherein the gypsum boards are brushed in order to remove gypsum dust thereform before spraying of the boards with water.

9. The method according to claim 1, wherein the speed of the pressurized air which is blown against the boards is about 50 m/sec.

* * * * *